US006315029B1

(12) United States Patent
Cho et al.

(10) Patent No.: US 6,315,029 B1
(45) Date of Patent: Nov. 13, 2001

(54) CONTINUOUS CASTING METHOD, AND DEVICE THEREFOR

(75) Inventors: Myung Jong Cho; Sang Joon Kim; Jong Keun Kim; In Cheol Kim, all of Kyungsangbook-do (KR)

(73) Assignees: Pohang Iron & Steel Co., Ltd.; Research Institute of Industrial Science & Technology, both of (KR)

( * ) Notice: Subject to any disclaimer, the term of this patent is extended or adjusted under 35 U.S.C. 154(b) by 0 days.

(21) Appl. No.: 09/509,706

(22) PCT Filed: Jul. 30, 1999

(86) PCT No.: PCT/KR99/00413

§ 371 Date: Mar. 31, 2000

§ 102(e) Date: Mar. 31, 2000

(87) PCT Pub. No.: WO00/07754

PCT Pub. Date: Feb. 17, 2000

(30) Foreign Application Priority Data

Aug. 4, 1998 (KR) ..... 98-31788

(51) Int. Cl.[7] ..... B22D 11/00; B22D 27/02

(52) U.S. Cl. ..... 164/466; 164/499; 164/504

(58) Field of Search ..... 164/466, 467, 164/468, 498, 499, 504, 513, 147.1

(56) References Cited

U.S. PATENT DOCUMENTS

| | | | | |
|---|---|---|---|---|
| 4,470,448 | | 9/1984 | Melford et al. | 164/504 |
| 4,495,984 | | 1/1985 | Kollberg | 164/468 |
| 5,025,853 | * | 6/1991 | Schmid | 164/504 |
| 5,095,969 | * | 3/1992 | Soejima et al. | 164/468 |
| 5,137,077 | * | 8/1992 | Sawada | 164/466 |
| 5,375,647 | * | 12/1994 | Fang et al. | 164/466 |
| 5,381,857 | * | 1/1995 | Tozawa et al. | 164/466 |
| 5,404,933 | | 4/1995 | Andersson et al. | 164/466 |
| 5,570,736 | * | 11/1996 | Nara et al. | 164/466 |

FOREIGN PATENT DOCUMENTS

| | | |
|---|---|---|
| 3122155 | 3/1982 | (DE) . |
| 0040383 | 11/1981 | (EP) . |
| 0317789 | 5/1989 | (EP) . |
| 8018372 | 6/1980 | (GB) . |
| 2284750 | 11/1990 | (JP) . |

* cited by examiner

*Primary Examiner*—Tom Dunn
*Assistant Examiner*—Len Tran
(74) *Attorney, Agent, or Firm*—Webb Ziesenheim Logsdon Orkin & Hanson, P.C.

(57) ABSTRACT

A continuous casting method, and a device for use in the casting method, are disclosed. The flow state of the discharged molten metal is properly controlled, and thus, the amounts of residual non-metallic inclusions and gas bubbles within the molten metal are decreased, so that continuously cast slabs of a good quality can be produced. The continuous casting device includes a mould with a submerged nozzle installed therein, the submerged nozzle having a pair of discharge holes directed toward narrow faces of the mould. Further, an electromagnetic brake ruler is included for establishing a magnetic field within the mould. The electromagnetic brake ruler includes a base frame surrounding the mould, and iron cores projecting from near the wide faces of the mould, while the iron cores are wound with induction coils. It further includes a pair of electromagnetic transferring parts connected to the iron cores, and disposed immediately above the discharge holes of the submerged nozzle toward narrow faces of the mould and in parallel with a discharge direction of the molten metal. With the magnetic field applied within the mould, the separation capability for the non-metallic inclusions and gas bubbles is increased so as to greatly reduce the internal defects of the cast products.

9 Claims, 10 Drawing Sheets

CONTINUOUS CASTING METHOD, AND DEVICE THEREFOR

FIELD OF THE INVENTION

The present invention relates to a continuous casting method, and a device for use in the casting method. More specifically, the present invention relates to a continuous casting method, and a device for use in the casting method, in which the flow state of the discharged molten metal is properly controlled, and thus, the amounts of residual non-metallic inclusions and gas bubbles within the molten metal are decreased, so that continuously cast slabs of a good quality can be produced.

BACKGROUND OF THE INVENTION

The molten metal continuous casting method has been adopted over the whole world since 1960s. This method has various advantages compared with the general ingot making method, and therefore, it is utilized for a considerable part of the manufactured steel.

The quality of a continuously cast metal is classified into a surface quality and an internal quality, and these qualities are closely related to the flow of molten metal within the mould.

FIGS. 1*a* and 1*b* illustrate a mould used in the general continuous casting method. Referring to these drawings, a molten metal is supplied into a mould 10 through a submerged nozzle 11 which has two discharge holes 11*a*. The molten metal which is discharged from the two discharge holes forms jet flows toward a narrow face 13, and the jet flow collides with the narrow face 13 to be divided into an ascending flow U and a descending flow D. That is, the jet flow is divided into four recirculating streams U1, U2, D1 and D2. In FIG. 1*b*, reference code S indicates a turning point of the recirculating streams.

The molten metal which is introduced into the mold contains non-metallic inclusions (also called "inclusions" below) such as $Al_2O_3$, MnO, $SiO_2$ and the like which have been formed in the pre-treating stage or have come from the refractory materials. The molten metal further includes inert gas bubbles (also called "gas bubbles" below) which have been injected into the submerged nozzle 11, for preventing the clogging of the nozzle 11. The gas bubbles have sizes of several scores of microns to several millimeters. The inclusions and gas bubbles which are contained in the upper recirculating streams have a density lower than that of the molten metal. Therefore, they are subjected to a floating force in a direction opposite from gravity, and therefore, they move in the combined vector direction of the molten metal flow and the floating force. Then they gradually move toward the meniscus of the molten metal, to be captured by the mold flux 14.

However, the inclusions and gas bubbles which are contained in the lower recirculating streams D pass through the jet flow region near the nozzle discharge holes 11*a* before moving toward the upper recirculating streams U. The velocity of the jet flow is faster than the ascending velocity due to the floating force, and therefore, the inclusions and the gas bubbles rarely pass through the jet flow. Accordingly, the inclusions and the gas bubbles which are contained in the lower recirculating streams cannot reach the meniscus of the molten metal, but continuously circulate along with the lower recirculating streams. Therefore, they are likely to remain within the cast metal. Particularly, in the case of the continuous curved caster, the particles contained in the lower recirculating streams spirally move due to the influence of the floating force to be ultimately adhered on the solidified layer, i.e., on the upper layer of the cast piece, thereby forming an inclusion/gas bubble accumulated region in the upper layer of the cast piece.

When the cast piece is subjected to a rolling, the residual inclusions and gas bubbles are exposed to the surface, thus causing surface defects. Or they remain within the cast piece, and when an annealing is carried out, the gas bubbles expand to cause internal defects.

In order to solve this problem and to improve the quality of the cast piece, conventionally the discharge angle Θ of the submerged nozzle is properly adjusted, so as to improve the quality of the cast piece. The discharge angle Θ of the submerged nozzle gives a great influence to the flow of the molten metal.

If the discharge angle Θ is increased, the amount of the descending flow increases, while that of the ascending flow decreases. As a result, the velocity of the molten metal on the meniscus of the melt is slowed, so that a stable surface of the melt is maintained. Therefore, the workability is improved, and the initial solidification is stably carried out, thereby upgrading the surface quality of the cast piece. However, if the discharge angle Θ is increased, large amounts of inclusions and gas bubbles are buried deeply into the cast piece, because they lose the opportunity of floating to the meniscus of the melt. Thus the internal quality of the cast piece is aggravated.

On the other hand, if the discharge angle Θ is decreased, the amount of the descending flow decreases, and therefore, the defects due to the inclusions and the gas bubbles may decrease. However, if the discharge angle is decreased, the amount of the ascending flow increases, and the velocity of the molten metal at the meniscus of the melt steeply increases. Therefore, the surface quality of the cast piece is decreased due to the entrainment of the mould flux at the melt surface, and due to the formation of vortex. These problems become much more serious as the casting speed becomes faster.

Thus, if only the submerged nozzle is employed, a limit in controlling the flow of the molten is confronted. Therefore, as shown in FIG. 2*a*, an electromagnetic brake ruler (EMBR) 20 is installed immediately below the discharge hole 11*a* of the submerged nozzle. Thus the Lorentz force based on a magnetic field and a flow is utilized to decrease the flow velocity. (This is proposed in Swedish Patent SE 8,003,695, and U.S. Pat. No. 4,495,984.)

The method of FIG. 2*a* has been put to the practical use, but it is not used at present because flow distortions occur in the direction of evading the flow resistance of the magnetic field, rather than decreasing the flow velocity by the magnetic field.

In order to overcome this problem, the magnetic field is horizontally distributed over the entire width of the mould as shown in FIGS. 2*b* and 2*c*. (Swedish Patent SE 9,100,184, U.S. Pat. No. 5,404,933, and Japanese Patent Application Laid-open No. Hei-2-284750). However, the distortion phenomenon has been observed in these methods all the same.

When a dc magnetic field is not applied, the molten metal which has been discharged from the discharge holes 11*a* of the submerged nozzle 11 forms flow fields as shown in FIG. 3*a*. However, if the magnetic field is applied over the entire width of the mould, the flow steams are formed as shown in FIG. 3*b*. That is, compared with the case where there is magnetic field, the jet flow is markedly spread in the thickness direction of the mould. Therefore, the average velocity of the jet flow directed toward the mould narrow face is slowed.

As the velocity of the jet flow is slowed, the inclusions and the gas bubbles of several scores to several hundreds of microns have a long way to travel from the descending flow region to the ascending flow region, compared with the case where a magnetic field is not applied.

Meanwhile, most of the inert gas which has been injected through the nozzle into the molten metal has of several millimeters, and floats from between the narrow faces to the meniscus of the melt (the floating distance depends on the molten metal injection speed and on the amount of the injected gas, and this distance corresponds from near the discharge hole to the narrow face in the case where the minimum gas amount is injected, while it corresponds from immediately above the discharge hole to the narrow face in the case where the maximum gas amount is injected). If the velocity of the main flow is light, the direction of the main flow is not greatly affected by the floating of the inert gas bubbles. However, if the average velocity of the main flow is decreased by applying a magnetic field, the direction of the main flow is greatly influenced by the floating force of the inert gas. The main flow is raised toward the surface of the melt by the floating force of the inert gas and by the flow resistance of the magnetic field which is established immediately below the submerged nozzle. When the influence by the floating force of the inert gas decreases, the flow is lowered in the casting direction to draw an S curve as shown in FIG. 3*b* (this is called "non-solidified rising molten metal flow adjacent to the submerged nozzle"). Thus the flow collides with the mould narrow race with a large angle.

When the jet flow is cleaved by colliding with the narrow face of the mould, the flow amounts of the cleaved flows are decided by the colliding angle. For example, if a perpendicular collision occurs, the upper and lower cleaved flows are same in their flow amounts. However, if the colliding angle is lowered, the amount of the lower flow is increased. Under this condition, the ratio of the amount of the lower flow to that of the upper flow is decided by the casting speed, the nozzle discharge angle, the injected amount of the inert gas, and the magnetic field strength. However, at the general working conditions, the ratio is about 6:4, if a magnetic Field is not applied. If a magnetic field is applied over the entire width, the ratio becomes 8:2. Therefore, if a magnetic field is applied like in the conventional method, the amount of the lower flow increases, while the amount of the upper flow decreases. Accordingly, the velocity of the molten metal decreases immediately below the melt meniscus, and the height difference of the melt meniscus also decreases. Thus the melt face is stabilized, so as to improve the surface quality.

However, due to the increase in the amount of the lower flow, large amounts of inclusions and gas bubbles are contained in the recirculating flow. Therefore, if a magnetic field is applied over the entire width, the increase of the floating opportunity owing to the decrease of the average velocity is offset. Therefore, the improvement of the internal quality cannot be expected due to the fact that the inclusions and the fine inert gas bubbles are not removed.

SUMMARY OF THE INVENTION

In order to solve the above described problems, the present inventors carried out theoretical studies and simulating experiments. Based on these studies and research, the present inventors came to propose the present invention.

Therefore it is an object of the present invention to provide a continuous casting method, in which an induced dc magnetic field is applied in parallel with the molten metal discharge direction, and thus, the residual amounts of inert gas bubbles and non-metallic inclusions such as $Al_2O_3$, MnO and the like are minimized, thereby improving the internal quality of the cast pieces.

It is another object of the present invention to provide a continuous casting device which is used for the above continuous casting method.

In achieving the above objects, the continuous casting method according to the present invention includes the steps of: feeding a molten metal through discharge holes of a submerged nozzle into a mould; and establishing a magnetic field on the incoming molten metal, characterized in that a main flux part of the magnetic field is distributed from immediately above the discharge holes of the submerged nozzle in parallel with a discharge direction of the molten metal.

In another aspect of the present invention, the continuous casting device according to the present invention includes: a mould with a submerged nozzle installed therein, the submerged nozzle having a pair of discharge holes directed toward narrow faces of the mould; and an electromagnetic brake ruler for establishing a magnetic field within the mould, and the electromagnetic brake ruler includes: a base frame surrounding the mould; iron cores projecting from near wide faces of the mould and with induction coils wound thereon; and a pair of electromagnetic transferring parts connected to the iron cores, keeping a certain distance from the wide faces of the mould, and disposed immediately above the discharge holes of the submerged nozzle toward narrow faces of the mould and in parallel with the discharge direction of the molten metal.

Further, the device of the present invention further includes a means for controlling a non-solidified rising molten metal flow near the submerged nozzle.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE INVENTION

Basically in the present invention, a proper magnetic field is established from immediately above discharge holes of a submerged nozzle within a mould, in parallel with the molten metal discharge direction.

Figure 4A:
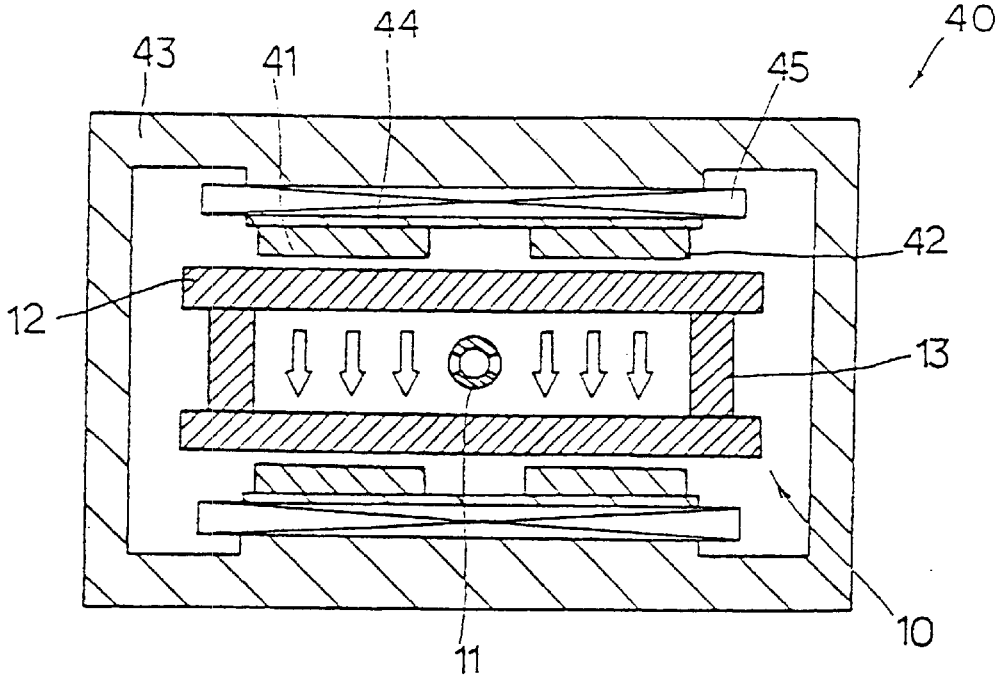
FIG. 4 illustrates the constitution of the continuous casting device according to the present invention, with FIG. 4*a* being a plan view, FIG. 4*b* being a side sectional view, and FIG. 4*c* being a perspective view of the critical portion.
Figure 4B:
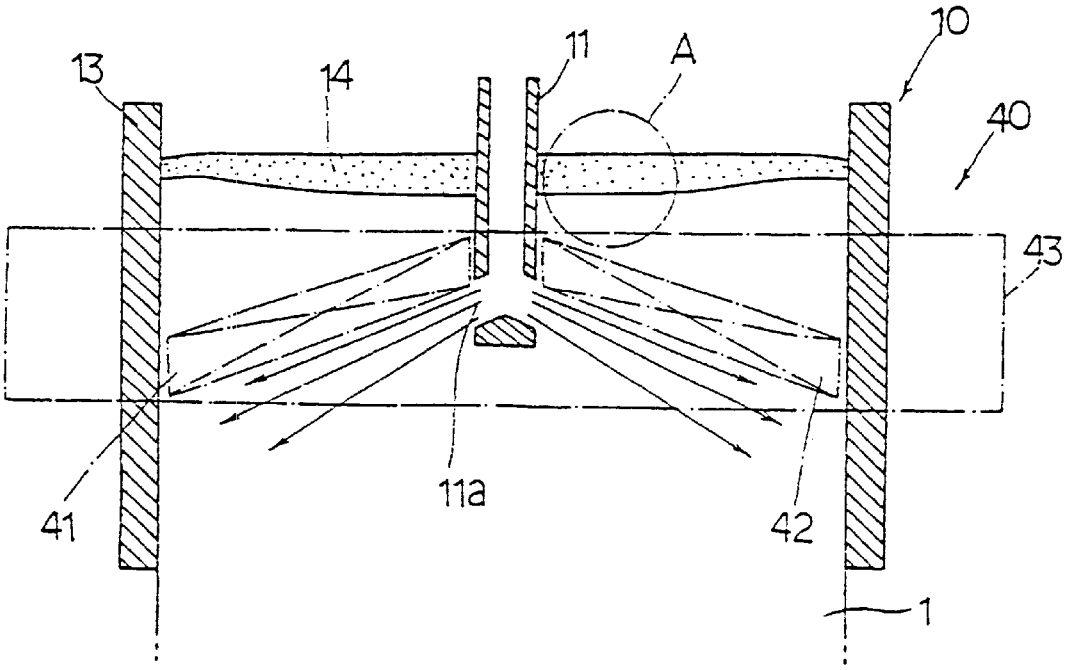

FIG. 4 illustrates the constitution of a first embodiment of the continuous casting device according to the present invention, with FIG. 4*a* being a plan view, and FIG. 4*b* being a side sectional view.

The continuous casting device according to the present invention includes: a submerged nozzle 11 with a pair of discharge holes 11*a* formed therein; a mould 10 with the submerged nozzle installed therein, the discharge holes 11*a* being directed toward narrow faces 13 of the mould 10; and an electromagnetic brake ruler 40 for establishing an induced magnetic field within the mould 10.

Figure 4C:
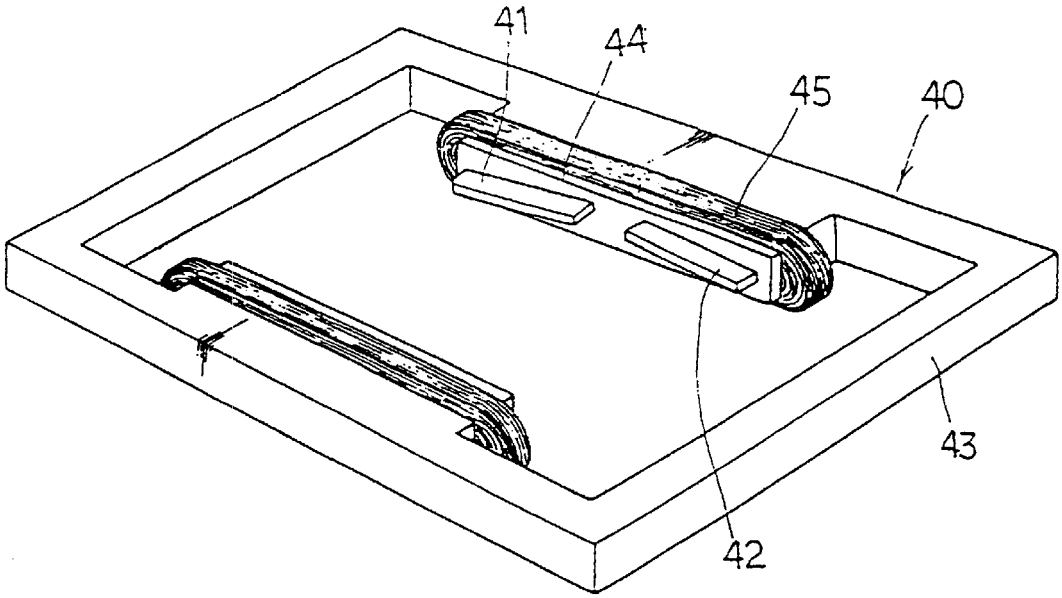

The major feature of the continuous casting device according to the present invention is the electromagnetic brake ruler. FIG. 4*c* illustrates in detail the electromagnetic brake ruler (EMBR).

As shown in FIG. 4*c*, the electromagnetic brake ruler 40 of the present invention includes: a base frame 43 surrounding the mould 10; iron cores 44 projecting from near wide faces 12 of the mould; and a pair of electromagnetic transferring parts 41 and 42 connected to the iron cores 44 and keeping a certain distance from the wide faces 12 of the mould 10.

The base frame 43 may be formed integrally with the iron cores 44. Or it may be formed separately from the iron cores in such a manner that it may be moved in the direction of the wide faces. In the latter case, the induction coils 45 can be easily wound.

The iron cores 44 are wound with the induction coils 45, and therefore, they may induce induction currents in the mould.

Further, the pair of electromagnetic transferring parts 41 and 42 are connected to the iron cores 44, keeping a certain distance from the wide faces of the mould, and thus supplies an induced dc magnetic field to the mould. The electromagnetic transferring parts 41 and 42 of the present invention are disposed starting from immediately above the discharge holes 11*a* of the submerged nozzle toward the narrow faces 13 of the mould and in parallel with the molten metal discharge directions. That is, the electromagnetic transferring parts 41 and 42 of the electromagnetic brake ruler 40 should be disposed in parallel with the discharge directions of the molten metal. The electromagnetic transferring parts 41 and 42 serve the role of changing the distribution contour of the magnetic field of the iron cores, before transferring the field to the mould. Therefore, they do not have to consist of a single piece, but may be a plurality of pieces.

The electromagnetic brake ruler 40 is a means for controlling the rising flow of the non-solidified molten metal near the submerged nozzle. The structure of the ruler 40 may be made different depending on the discharge angle of the molten metal. The discharge angle Θ of the discharge holes may be inclined downward at angle of 1 to 90 degrees. The electromagnetic transferring parts 41 and 42 should be disposed in parallel with the discharge direction of the molten metal even in the case where the discharge angle Θ is varied.

Meanwhile, in the electromagnetic brake ruler 40, as shown in FIG. 4*b*, the electromagnetic transferring parts 41 and 42 may extend up to the narrow face 13 of the mould. However, it is important that the parts 41 and 42 should cover the region immediately above the molten metal jet nearest to the submerged nozzle (or the region where floating of the inert gas is brisk). In the region immediately above the molten metal jet, the floating of the inert gas is most brisk. Therefore, in this region, numerous gas bubbles can be observed, and the size of this region depends on the casting speed and the injection amount of the inert gas. Under the usual conditions, the mentioned region is positioned between the submerged nozzle and the narrow face. In the case where the electromagnetic brake ruler 40 covers the area immediately above the molten metal jet, the constitutions of the base frame 53, the iron core 54 and the induction coil 55 are as shown in FIG. 5*b*, and are similar to those of FIG. 4*c*. However, the transferring parts 51 and 52 become short so as to cover only the region immediately above the molten metal jet.

That is, the electromagnetic brake ruler 40 should cover the region immediately above the molten metal jet nearest to the submerged nozzle at least, and should extend up to the narrow face of the mould at most.

Now the continuous casting method using the above described apparatus will be described.

Generally, if a conductive material moves across magnetic fluxes, then electric currents are induced in the conductive material. Owing to the interaction between the induced electric currents and the magnetic field, the Lorentz force is generated, which acts in a direction opposite to the motion of the conductive material, and is proportional to the multiplication of the moving velocity of the conductive material by the square of the applied magnetic field strength. The Lorentz force reduces the velocity of the flow, alters the direction of the flow, or cleaves the flow into a plurality of streams. Accordingly, if a magnetic field is properly applied over a flow, then the flow velocity and the flow direction can be properly altered.

The present invention is based on this principle. That is, during a continuous casting of a metal, the residual inclusions and gas bubbles are minimized, so that the internal quality problem of the cast product is improved. However, the method of the present invention has an essential difference from the conventional methods as described below.

That is, if the residual inclusions and gas bubbles within the cast product are to be minimized, the inclusions and gas bubbles should be contained in the upper layer of the recirculating stream to the maximum. That is, they have to be made to float.

For this, the following conditions have to be satisfied.

First, the velocity of the jet flows discharged from the discharge holes has to be slowed before the jet flow is divided into an ascending flow and a descending flow. Thus, a sufficient time has to be secured so that the inclusions and gas bubbles contained in the descending flow can float toward the surface of the ascending flow.

Second, the flow direction has to be controlled so that the collision angle of the jet flow of the molten metal at the narrow face would not be lowered. Thus the amount of the ascending flow has to be made greater, so that the greater part of the inclusions and gas bubbles will be contained in the ascending flow.

Figure 5A:
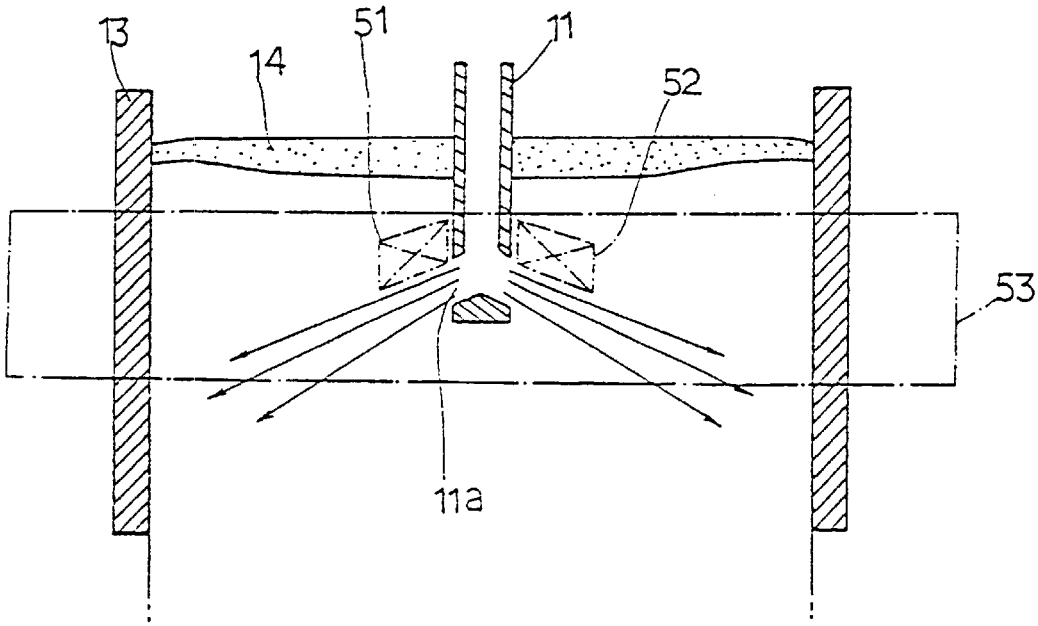
FIG. 5 illustrates the constitution of another embodiment of the continuous casting device according to the present invention, with FIG. 5*a* being a side sectional view, and FIG. 5*b* being a perspective view of the critical portion.
Figure 5B:
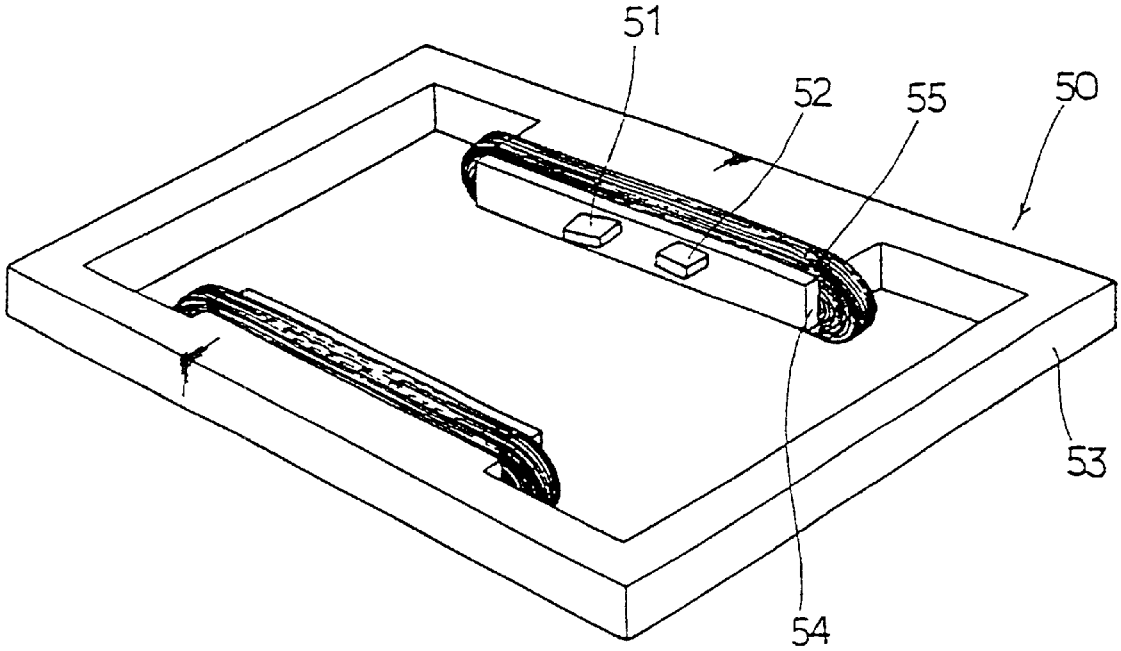

For this purpose, in the continuous casting devices of FIGS. 4 and 5, magnetic fluxes are applied in parallel with the discharge direction of the molten metal jet.

Figure 3A:
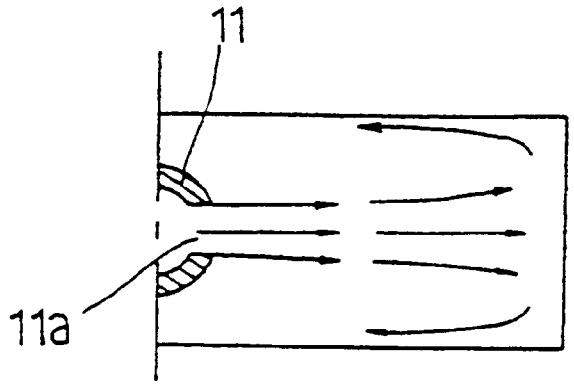
FIGS. 3*a* and 3*b* illustrate the molten metal flow within the mould in accordance with the presence or absence of the conventional electromagnetic brake ruler.
Figure 3A:
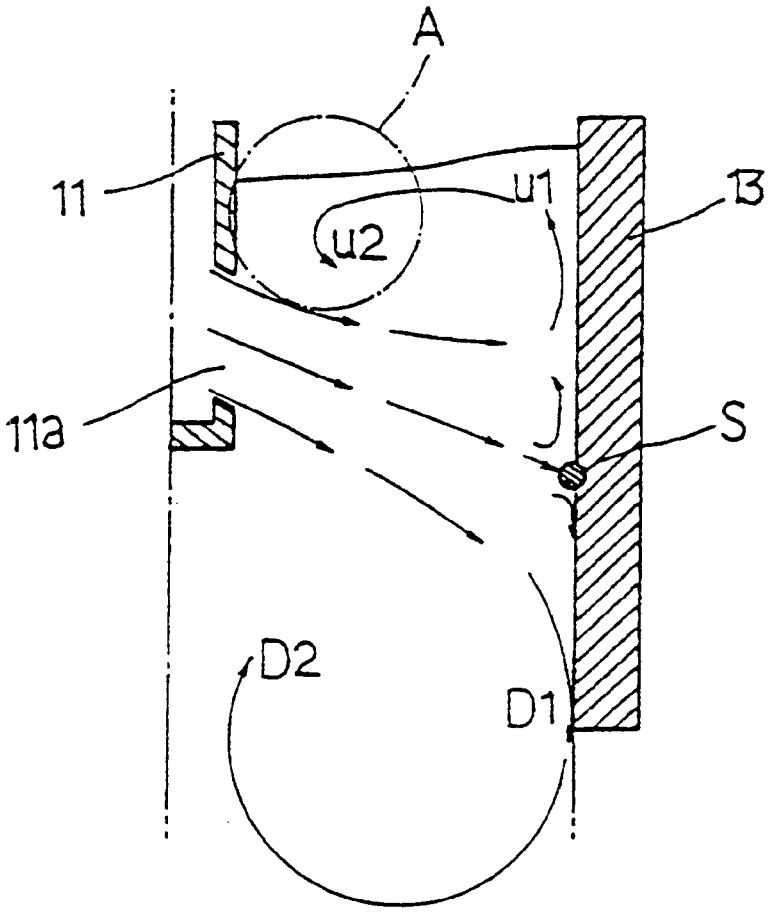
Figure 3B:
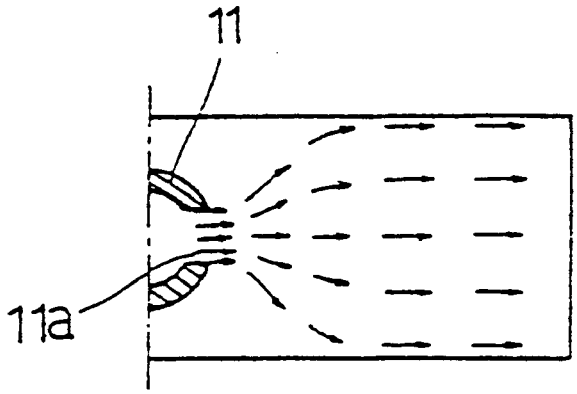
Figure 3B:
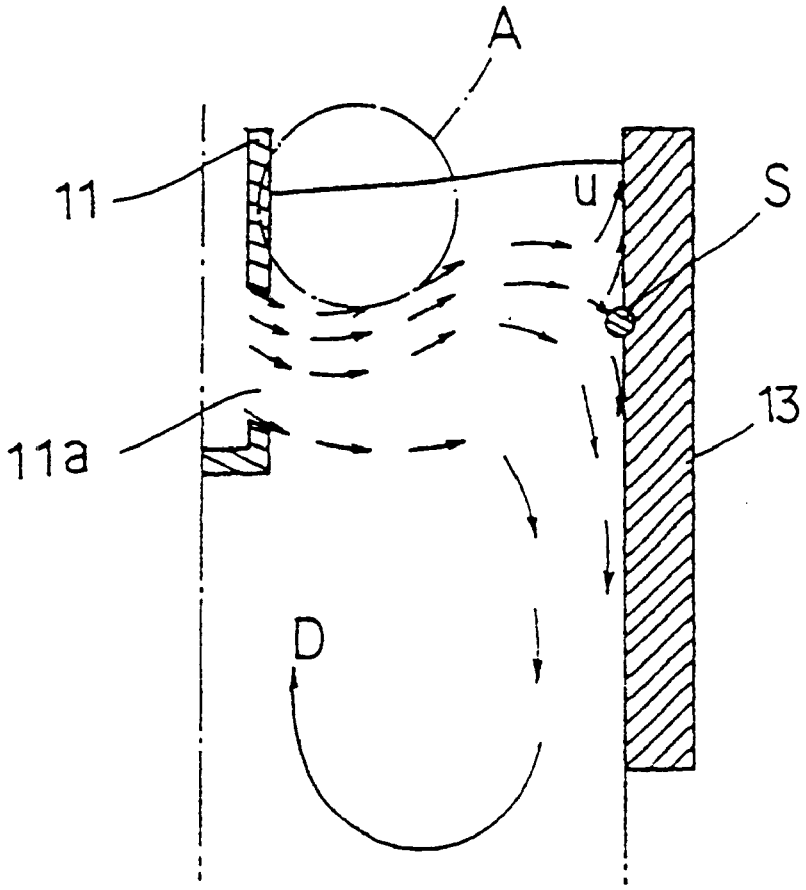
Figure 7:
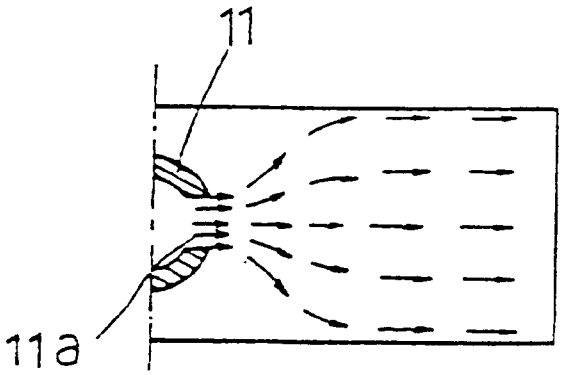
FIG. 7 illustrates the flow of the discharged molten metal within the mould of the present invention.
Figure 7:
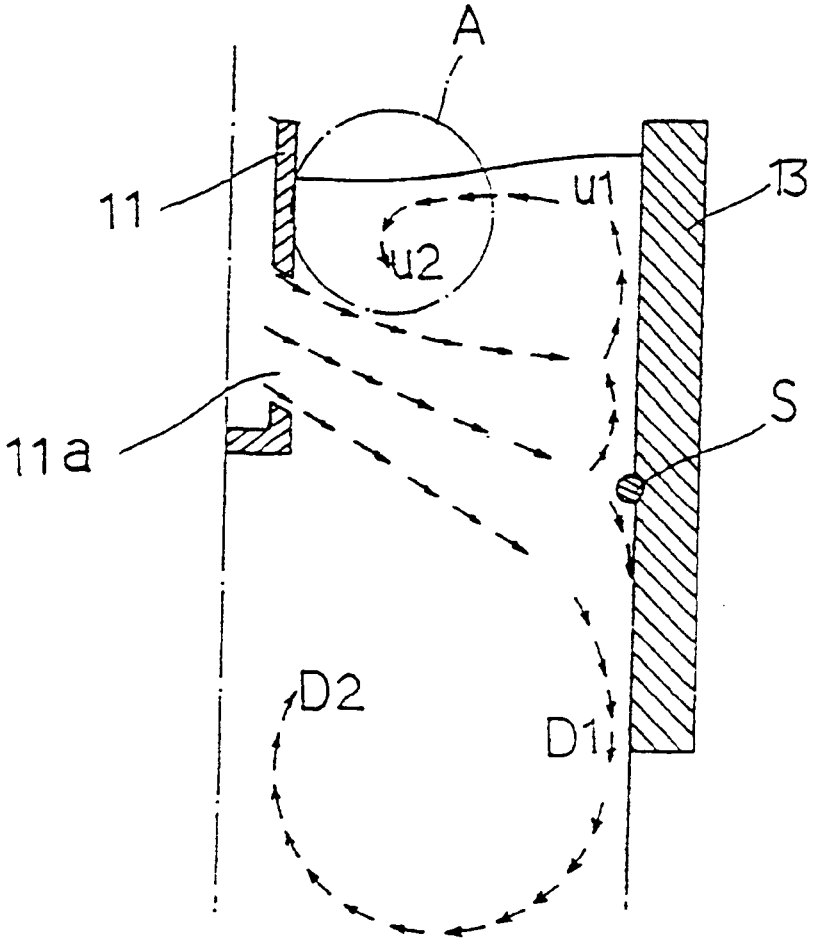

That is, if the magnetic field is distributed in parallel with the discharge direction of the molten metal jet, then the jet flow becomes as shown in FIG. 7. Consequently, the plan view of the jet flow pattern becomes as shown in the upper portion of FIG. 3*b*, while its frontal view is as shown in the lower portion of FIG. 3*a*. Thus the overall molten metal flow is slowed. Therefore, in the present invention, the flow is spread in the thickness direction of the mould as well as being slowed, so that the time for floating of the inclusions and gas bubbles can be sufficiently secured. At the same time, at the portion A of FIG. 4*b* where the floating force acts, the rising of the flow is inhibited by the flow resistance owing to the magnetic field applied above the flow. Further, the flow direction is made not to be distorted, and the colliding angle (at the narrow face) is sufficiently secured, so that the amount of the descending flow would not increase.

Thus the inclusions and gas bubbles contained in the descending flow are minimized.

Meanwhile, the colliding angle of the molten metal becomes different depending on the discharge angle at the submerged nozzle, the length of the applied magnetic field, and its field strength. If the colliding angle becomes unnecessarily upward, the flow velocity on the melt surface becomes too fast. Therefore, the floating time has to be designed such that the maximal floating can be realized with the minimal ascending flow amount.

The length of the electromagnetic brake ruler 40 should be such that it should extend from the molten metal discharge point to the narrow face at the maximum. The variation of the flow of the molten metal in accordance with the length of the magnetic field is illustrated in FIG. 8.

Figure 8A:
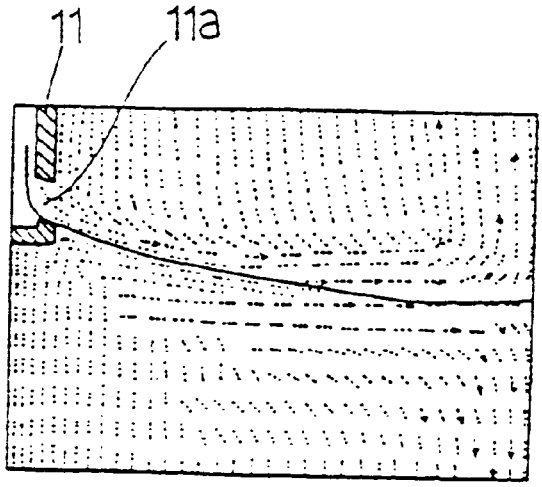
FIGS. 8*a* and 8*b* comparatively illustrate the molten metal flows for different embodiments of the continuous casting device according to the present invention.
Figure 8B:
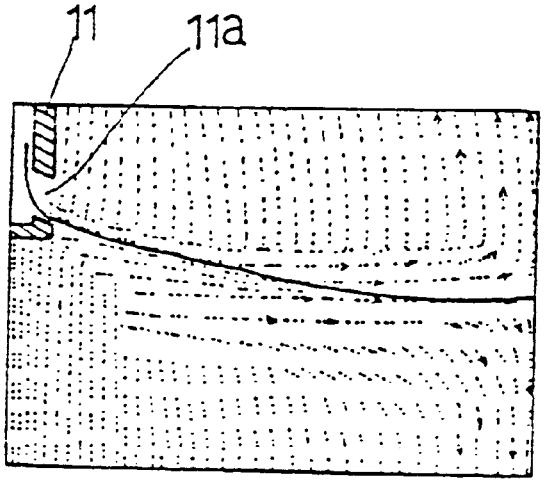

That is, FIG. 8*a* illustrates a case where a brisk floating occurs in a region corresponding to ¼ of the length from the discharge hole 11*a* to the narrow face. That is, the electromagnetic brake ruler 40 covers only this region (immediately above the molten metal jet). FIG. 8*b* illustrates a case where the ruler 40 is extended up to the narrow face. In both of the drawings, the flow patterns of the discharged molten metal are illustrated. It is seen that in both of the cases, the flow patterns are almost the same. This owes to the fact that the majority of the inert gas floats from near the discharge hole to the melt surface, and that the floating of the inert gas slightly pushes up the molten metal flow. However, it is seen that the magnetic field cannot give any great influence to the flow of the molten metal near the narrow face.

Figure 6:
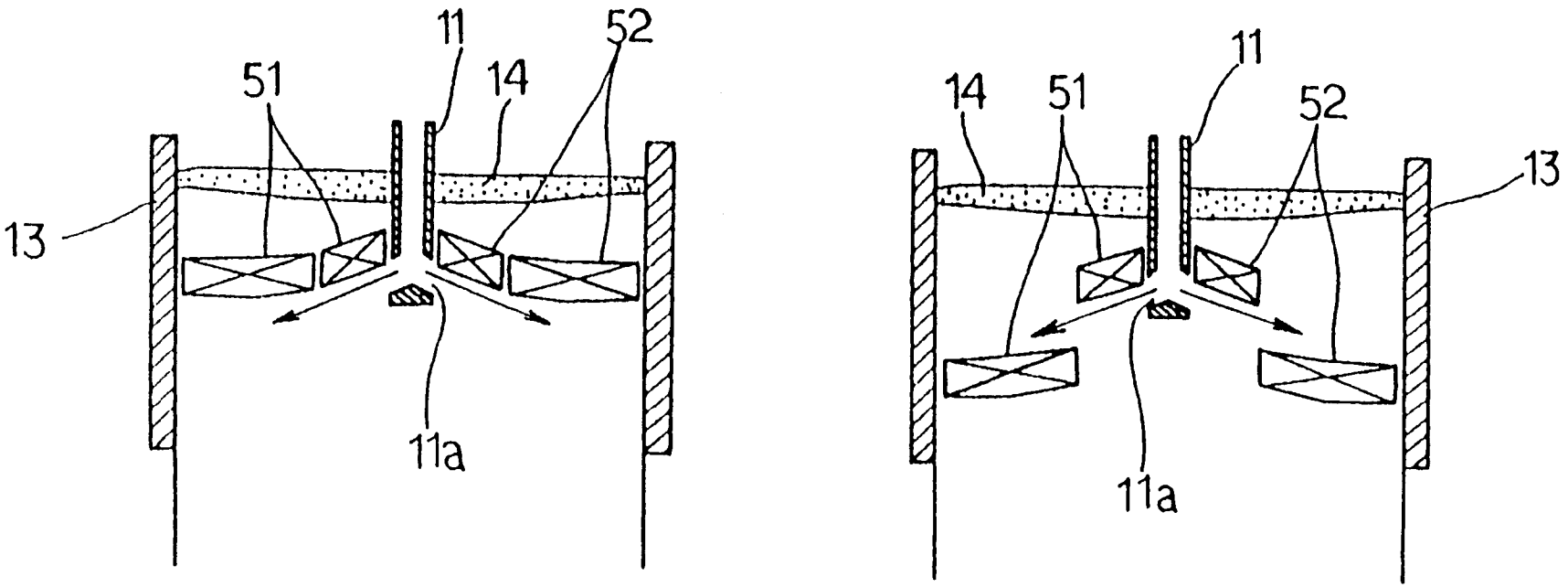
FIG. 6 is a side sectional view of the continuous casting device in which the electromagnetic transferring parts of the second embodiment are added.

Accordingly, if the upward biasing of the flow is inhibited at the region where the floating is brisk, then the overall flow pattern of the molten metal will become the same in both of the above mentioned cases. Further, near the narrow face remote from the brisk floating region, the molten metal has been spread in the thickness direction of the mould, and has been slowed. Therefore, the Lorentz force become negligible in this area. Consequently, it is important that the electromagnetic brake ruler 40 should cover at least the region where the floating of the inert gas is brisk. Outside this region, the distribution of the magnetic field is not very important. Therefore, a plurality of pieces of the electromagnetic transferring parts may be provided as shown in FIG. 6 in such as manner that the inhibited non-solidified molten metal flow is not destroyed, and that the pieces should extend up to the narrow face outside the brisk region. In this manner, fine adjustments of the flow near the narrow face are possible. FIG. 6 illustrates a case where the electromagnetic transferring parts with a varied angle are disposed near the narrow face outside the brisk floating region, so that the colliding angle can be adjusted slightly upward, in a state where the non-solidified rising molten metal flow is inhibited. FIG. 6 also illustrates a case where the electromagnetic transferring parts are added below the flow near the narrow face so as to reduce the velocity of the descending flow. In order to carry out fine adjustments near the narrow face, the electromagnetic transferring parts of various shapes may be added near the narrow face.

When carrying out the continuous casting using the above described casting device, about 35–40% of discharged amount of the molten metal can be made to ascend.

Here, the magnetic flux density of the electromagnetic brake ruler 40 should be preferably 1000–6000 Gausses. If the applied flux density is less than 1000 Gausses, the altering of the flow becomes insufficient, while if it exceeds 6000 Gausses, any more altering of the flow cannot be expected.

Now the present invention will be described based on experimental examples.

Comparative Example 1

Like in the general casting conditions, a molten metal discharge rate of 2.6 tons/min was adopted, and the downward discharge angle was adjusted to 0–25 degrees. With a magnetic field not applied, a computer-aided simulating experiment was carried out. Thus a comparison was made between the upper recirculating stream and the lower recirculating stream to measure the number of the inclusions and gas bubbles.

In the case where a magnetic field was not applied, 35–40% of the discharged molten metal was formed into an ascending flow, the rest forming a descending flow. The time for the discharged jet flow to reach the narrow face was about 0.55–1 second. Thus about 70% of the inclusions and gas bubbles was contained in the upper recirculating stream, while the rest is contained in the lower recirculating stream.

Comparative Example 2

Figure 1A:
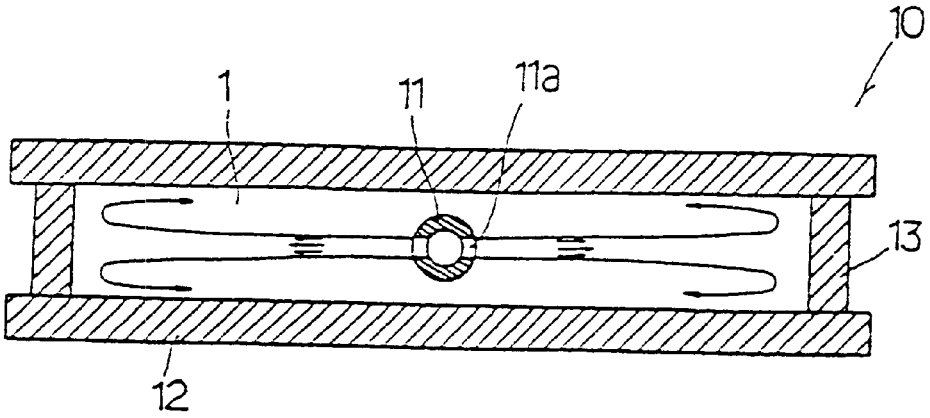
FIG. 1 illustrates the flow of the molten metal within the general mould, with FIG. 1*a* being a plan view, and FIG. 1*b* being a side sectional view.
Figure 1B:
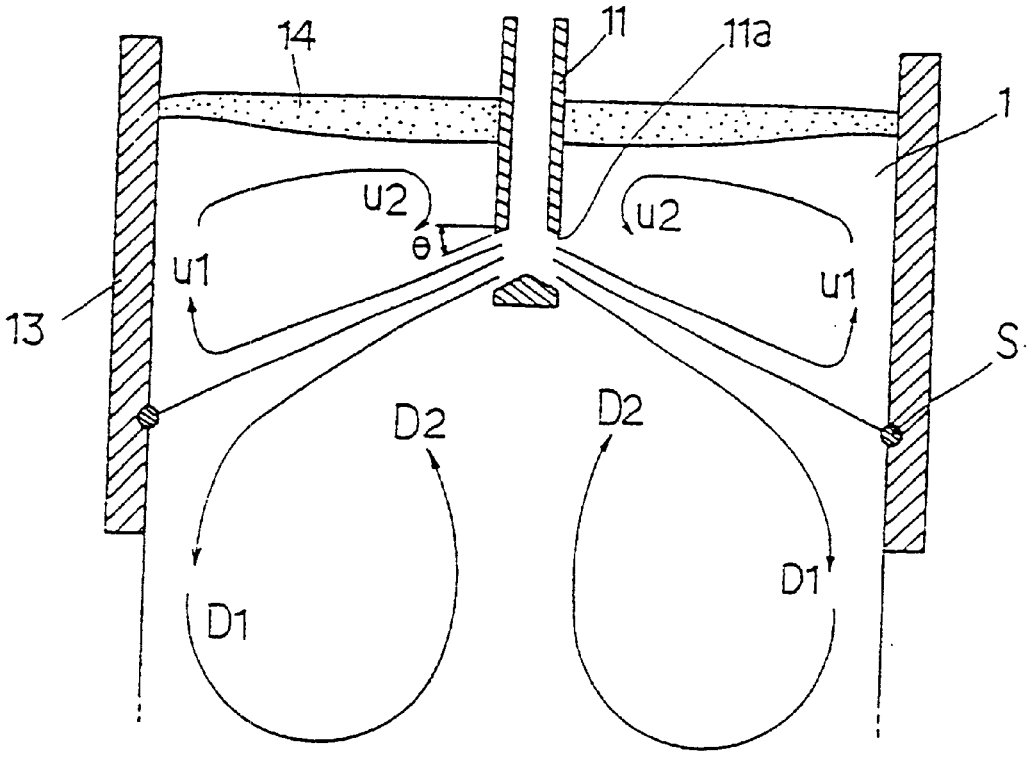
Figure 2A:
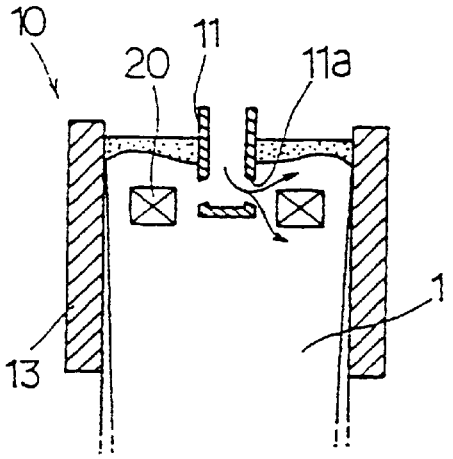
FIGS. 2*a*, 2*b* and 2*c* illustrate the constitutions of the conventional continuous casting devices, with various electromagnetic brake rulers being installed thereon.
Figure 2B:
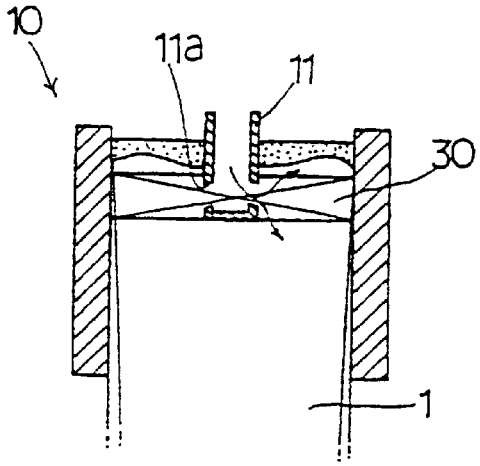
Figure 2C:
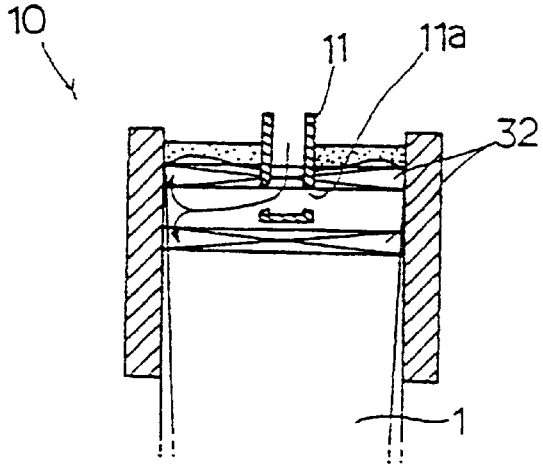

At conditions the same as those of the comparative example 1, a magnetic field was applied as shown in FIG. 2*b* to carry out a computer-aided simulating experiment. Then a comparison was made between the upper recirculating stream and the lower recirculating stream to measure the inclusions and gas bubbles.

In this case, only about 10–20% of the discharged molten metal was formed into an ascending flow, and about 34% of the inclusions and gas bubbles were floated to the upper recirculating stream, while the remaining 66% was contained in the lower recirculating stream. The time for the discharge jet flow to reach the narrow face was about 1.4–3 seconds in average.

From the above results, it is seen that it was worse than the case where a magnetic field was not applied. This corresponds to the actual factory circumstance.

Inventive Example

At conditions the same as those of the comparative example 1, a magnetic field was applied as shown in FIG. 4*b*. Then a computer-aided simulating experiment was carried out, and then, a comparison was carried out between the upper recirculating stream and the lower recirculating stream to measure the inclusions and gas bubbles. Here, the flux density of the applied magnetic field was varied within the range of 1000–6000 Gausses.

In this inventive example, about 35–40% of the discharged molten metal was formed into an ascending flow. The time for the discharged jet flow to reach the narrow face was about 1.4–3 seconds in average. Further, about 93% of the inclusions and gas bubbles were floated to the upper recirculating stream, while only 9% of them remained in the lower recirculating stream. Thus the separation of the inclusions and gas bubbles was much superior.

According to the present invention as described above, the separation capability for the non-metallic inclusions and the gas bubbles is improved. Therefore, the internal defects of the cast piece due to the non-metallic inclusions and the gas bubbles are markedly diminished.

What is claimed is:

1. A continuous casting method comprising the steps of:

feeding a molten metal through discharge holes of a submerged nozzle into a mould; and establishing a magnetic field on the molten metal thus fed, characterized in that a main flux part of the said magnetic field is distributed from immediately above said discharge holes of said submerged nozzle in parallel with discharge direction of the molten metal, wherein 35–40% of the molten metal thus discharged is made to ascend by the magnetic field.

2. The continuous casting method as claimed in claim 1, wherein the magnetic field thus applied has a flux density of 1000–6000 Gausses.

3. A continuous casting device comprising:

a mould with a submerged nozzle installed therein, said submerged nozzle having a pair of discharge holes directed toward narrow faces of said mould; and an electromagnetic brake ruler for establishing a magnetic field within said mould, said electromagnetic brake ruler comprising:

a base frame surrounding said mould;

iron cores projecting from near wide faces of said mould and with induction coils wound thereon; and a pair of electromagnetic transferring parts connected to said iron cores, keeping a certain distance from said wide faces of said mould, and disposed immediately above said discharge holes of said submerged nozzle toward narrow faces of said mould and in parallel with a discharge direction of the molten metal.

4. A continuous casting device comprising:

a control means for controlling a non-solidified ascending molten metal flow near said submerged nozzle, wherein said control means comprises at least a pair of electromagnetic transferring parts for applying magnetic fields;

said electromagnetic transferring parts are connected to iron cores disposed in parallel with a molten jet flow direction near said discharge hole of said submerged nozzle;

and said electromagnetic transferring parts establish main magnetic fluxes perpendicular to a flow of the molten metal and perpendicular to a drawing direction of cast strands.

5. The continuous casting device as claimed in claim 4, wherein said electromagnetic transferring parts cover a region immediately above the molten metal jet nearest to said submerged nozzle.

6. The continuous casting device as claimed in claim 5, wherein said electromagnetic transferring parts have an arbitrary shape at a region where a floating of inert gas is not brisk, that is, outside a region immediately above the molten metal jet nearest said submerged nozzle.

7. The continuous casting device as claimed in claim 5, wherein the magnetic field has a flux density of 1000–6000 Gausses.

8. The continuous casting device as claimed in claim 4, wherein disposed angles of said electromagnetic transferring parts are varied within a range of 1 to 90 degrees, so as to make them parallel with the molten metal jet flow near said submerged nozzle.

9. The continuous casting device as claimed in claim 4, wherein said control means has an operation range falling between said discharge holes and said narrow faces.

* * * * *

UNITED STATES PATENT AND TRADEMARK OFFICE

CERTIFICATE OF CORRECTION

PATENT NO. : 6,315,029 B1
DATED : November 13, 2001
INVENTOR(S) : Myung Jong Cho et al.

It is certified that error appears in the above-identified patent and that said Letters Patent is hereby corrected as shown below:

Column 3,
Line 7, "has of" should read -- has bubble sizes of --.
Line 16, "main flow is light," should read -- main flow is high, --.
Line 29, "race" should read -- face --.
Line 40, "magnetic Field" should read -- magnetic field --.

Column 10,
Line 27, "in claim 5" should read -- in claim 4 --.

Signed and Sealed this

Sixth Day of August, 2002

*Attest:*

*Attesting Officer*

JAMES E. ROGAN
*Director of the United States Patent and Trademark Office*